US010024118B2

(12) United States Patent
Stolt et al.

(10) Patent No.: US 10,024,118 B2
(45) Date of Patent: Jul. 17, 2018

(54) SINKER BAR

(71) Applicant: American Sinker Bars, Odessa, TX (US)

(72) Inventors: John Stolt, Brenham, TX (US); Jeff De La Paz, Odessa, TX (US); Johnny Fayo, Odessa, TX (US)

(73) Assignee: American Sinker Bars, LLC, Odessa, TX (US)

( * ) Notice: Subject to any disclaimer, the term of this patent is extended or adjusted under 35 U.S.C. 154(b) by 123 days.

(21) Appl. No.: 15/186,085

(22) Filed: Jun. 17, 2016

(65) Prior Publication Data

US 2016/0369574 A1 Dec. 22, 2016

Related U.S. Application Data

(60) Provisional application No. 62/181,596, filed on Jun. 18, 2015, provisional application No. 62/181,579, filed on Jun. 18, 2015.

(51) Int. Cl.

| | |
|---|---|
| ***E21B 17/00*** | (2006.01) |
| ***E21B 17/042*** | (2006.01) |
| ***E21B 19/16*** | (2006.01) |
| ***E21B 43/12*** | (2006.01) |

(52) U.S. Cl.
CPC ..... *E21B 17/006* (2013.01); *E21B 17/042* (2013.01); *E21B 19/16* (2013.01); *E21B 43/127* (2013.01)

(58) Field of Classification Search
CPC ..... E21B 17/00; E21B 17/006
See application file for complete search history.

(56) References Cited

U.S. PATENT DOCUMENTS 4,289,548 A * 9/1981 Bucher ..... C21D 8/06 148/320

OTHER PUBLICATIONS

Specification for Sucker Rods,Polished Rods and Liners, Couplings,Sinker Bars, Polished Rod Clamps,Stuffing Boxes, and Pumping Tees from API Specification 11b effective date Nov. 1, 2010. (Year: 2010).*

* cited by examiner

*Primary Examiner* — Giovanna C. Wright
(74) *Attorney, Agent, or Firm* — Ramey & Schwaller, LLP

(57) ABSTRACT

The sinker bar can have at least one pin with a shoulder that is at least 1.600 inches from the end of the pin to provide greater stability and easy make-up. The modified polished rod pin is capable of mating with a polished rod coupling.

18 Claims, 4 Drawing Sheets

SINKER BAR

RELATED APPLICATIONS

This application claims priority to U.S. Provisional Application No. 62/181,579, filed Jun. 18, 2015 and U.S. Provisional Application No. 62/181,596, filed Jun. 18, 2015, all incorporated by reference.

FIELD

The disclosure relates generally to sinker bars. This disclosure relates specifically to sinker bars with an improved pin.

BACKGROUND

Sinker (or weight) bars add weight to the tool string to overcome well bore pressure and pull the tool string into the well. Sinker bars help to keep the rod string in tension by providing extra weight. Sinker bars counteract the high hydraulic pressures at the bottom of the tubing. The lower portion of the sucker rod string is forced upward and can be compressed. The compression can cause the sucker rod string to bend. Sinker bars also help prevent the rubbing of the sucker rods on the well bore because the weight holds the sucker rod string in tension.

It would therefore be advantageous to have a sinker bar with greater stability and easier make-up. Faster make-up of the strings of sinker bars takes less time and is more efficient.

SUMMARY

An embodiment of the disclosure is a sinker bar comprising an elongated tubular body having a shoulder portion present on at least one end of the tubular body; a polished rod pin integrally adjacent to the shoulder portion of the elongated tubular body, wherein the polished rod pin comprises an polished rod pin end opposite of the shoulder portion; wherein the shoulder portion is located at least 1.600 inches from the end of the polished rod pin; and wherein the polished rod pin can be mated with a coupling. In an embodiment, the sinker bar further comprises a gauge ring. In an embodiment, the gauge ring is located about 1.436 inches from the polished rod pin end. In an embodiment, the shoulder portion forms a 45 degree angle to the gauge ring. In an embodiment, the sinker bar further comprises a threaded connector portion of the pin. In an embodiment, the threaded connector portion forms a 9 degree angle to the gauge ring. In an embodiment, the threaded connector portion is in proximity to the gauge ring. In an embodiment, the threaded connector portion is in proximity to the polished rod pin end. In an embodiment, the threaded connector portion is between about 0.8 inches and 2.0 inches long. In an embodiment, the sinker bar is comprised of at least one of the group consisting of carbon steel bar stock or alloy steel bar stock. In an embodiment, the sinker bar stock is hot-rolled and cold-drawn.

An embodiment of the disclosure is a method of preparing a production string comprising attaching the sinker bar of claim 1 to a string of at least one other sinker bar; attaching a sucker rod to a string of at least one sinker bar; and attaching a pump to a string of at least one sucker rod. In an embodiment, the sinker bar further comprises a gauge ring. In an embodiment, the gauge ring is located about 1.436 inches from the polished rod pin end. In an embodiment, the shoulder portion forms a 45 degree angle to the gauge ring. In an embodiment, the sinker bar further comprises a threaded connector portion of the pin. In an embodiment, the threaded connector portion forms a 9 degree angle to the gauge ring. In an embodiment, the threaded connector portion is between about 0.8 inches and 2.0 inches long. In an embodiment, the sinker bar is comprised of at least one of the group consisting of carbon steel bar stock or alloy steel bar stock. In an embodiment, the sinker bar stock is hot-rolled and cold-drawn.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

Figure 1A:
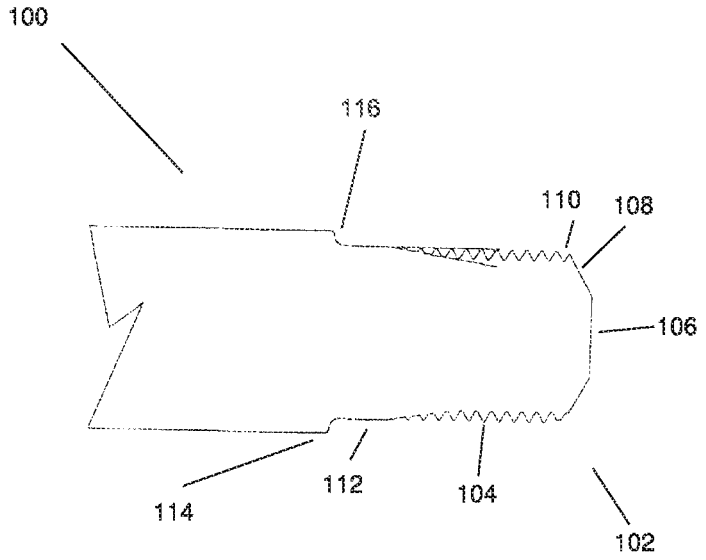
FIG. 1A depicts a side view of the modified polished pin portion of a sinker bar.

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

A sucker rod is a steel or fiberglass rod that is threaded at both ends. It is used to join together the components of a reciprocating piston pump in an oil well. The top of the sucker rod string is attached to a pump to cause the sucker rod string to move up and down in the well and cause any well fluids to move upward to the surface. The depth of the well, rod size, hydrostatic head, friction force, and safety factor can be used to determine how many sinker bars to use. In an embodiment, a sinker bar weight is added as needed in order to obtain the desired downward movement. Sinker bars can be combined with sucker rods via couplings and the threaded portions on the pin the sinker bar. In an embodiment, the sucker rod can be attached to the sinker bar. In an embodiment, the sinker bars are connected using a coupling.

In an embodiment, sinker bars are elongated tubular bodies. In an embodiment, the sinker bar is between about 15-40 feet. In an embodiment, the sinker bar is between about 20 and 30 feet. In an embodiment, the sinker bar is about 25 feet. In an embodiment, the sinker bar length can be shorter in order to travel through a bend in the well. If a sinker bar section is too short, rod buckling will occur above it. If sinker bar section is too long, there will be excessive energy usage.

Couplings can attach adjacent sinker bars or sinker bars to sucker rods. The threads on the pins screw into couplings. There are at least two kinds of couplings used with sinker bars, polished rod couplings and sucker rod couplings. As many sinker bars or sucker rods can be attached together as necessary. In an embodiment, the sinker bar is a larger diameter than the sucker rod.

Thread ring gauges are manufactured according to American Petroleum Institute (API) specifications. The gauges are used to inspect the sucker rod pin or polished rod pin to determine if the pin complies with API standards.

In an embodiment, the polished rod pin has been modified so that it can be used with a polished rod coupling. Generally, sucker rod pins and sucker rod couplings do not have a 9° taper on the final threads. Generally, polished rod pins have a 9° taper on the final threads and polished rod couplings have a 9° vanish cone. When a polished rod pin and polished rod coupling are used together, it provides a mechanical lock. Therefore, sucker rod couplings could not be used with polished rod pins. However, a sucker rod pin can be used with a polished rod coupling. The polished rod pin threads with the 9° taper will not mate with the parallel threads of a sucker rod coupling. Failure of the polished rod pin or coupling could occur if a sucker rod coupling is used with a polished rod pin. In an embodiment, a fracture of the couplings could occur when using a sucker rod coupling and the current modification. The polished rod pin can be used with a sucker rod coupling. The modification of the polished rod allows a polished rod pin to work with the coupling. The modification to the polished rod pin to have the shoulder located farther from the end allows the polished rod pin to function with the polished rod coupling. The polished rod pin provides a better connection. The modification allows the threads of the polished rod pin to make properly with the parallel threads of the polished rod coupling. The shoulder has been moved to 1.6 inches from the end of the polished rod pin so that the polished rod pin on the sinker bar can be used with a polished rod coupling. The modified polished rod pin allows for a greater number of engaged threads. A gauge ring has been added to the pin. The ring gauges allow a gauge to be placed on the pin for API standards. In an embodiment, the gauge ring is located at 1.436 inches from the end of the pin.

FIG. 1A depicts a sinker bar 100 with a modified polished pin 102. In an embodiment, the sinker bar has two bevels 108 and 110 on the nose 106 of the pin 102. The first bevel 108 is 30 degrees and the second bevel 110 is 45 degrees. In an embodiment, a portion of the nose 106 of the sinker bar 100 is flat. In an embodiment, the shoulder 116 is moved back so that it does not act as a stop for the threaded connector portions 104 of the sinker bar 100. In an embodiment, the angle of the shoulder is 45 degrees. In an embodiment, the coupling can tighten up on the 9 degree taper of the pin 102.

Figure 1B:
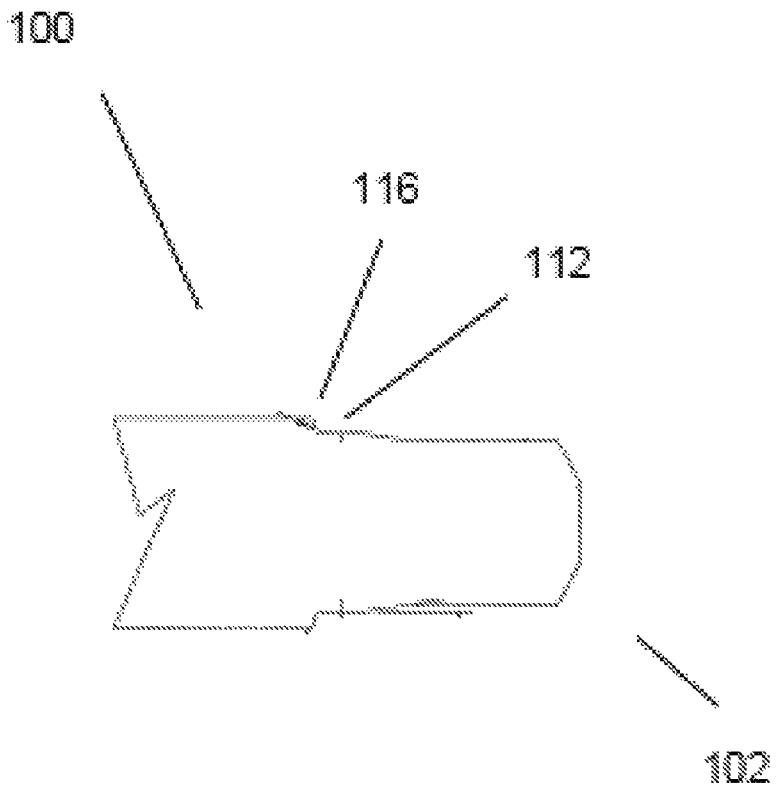
FIG. 1B depicts a side view of the modified polished pin portion of a sinker bar.

FIG. 1B depicts a side view of the modified polished pin portion 102 of a sinker bar 100. In an embodiment, the shoulder 116 is moved back. A gauge ring 112 is present. In an embodiment, the coupling can tighten up on the 9 degree taper of the pin 102.

Figure 2:
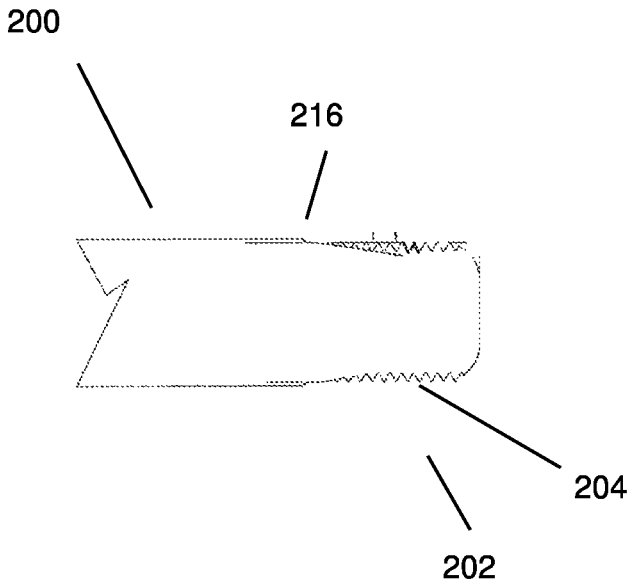
FIG. 2 depicts an API polished rod pin.

FIG. 2 depicts an API polished rod pin 202 on a sucker rod 200. The shoulder 216 on the API pin is only 1.375 inches from the end of the pin. There is a threaded connector portion 204 present on the API polished rod pin 202.

In an embodiment, the distance from the shoulder to the end of the improved pin is about 1.600 inches. In an embodiment, the distance from the shoulder to the end of the improved pin is from 1.45-1.7 inches.

In an embodiment, the shoulder on the API pin is 1.375 inches from the end of the pin. The short distance on the API pin from the shoulder to the end does not allow the coupling and sucker rod to screw together properly. Make-up is the assembly and joining of the parts such as a string of casing. Make-up can include the screwing together of two threaded connector pieces. The bevels at the end of the pin allow for easy make-up.

In an embodiment, the diameter of the pin is about 0.995 inches. In an embodiment, the diameter of the pin is from 0.9-1.0 inches. In an embodiment, the diameter at the gauge ring is 1.068. In an embodiment, the diameter at the gauge ring is from 0.95-1.15 inches. In an embodiment, the diameter of the sucker rod is 1.25 inches. In an embodiment, the diameter of the sucker rod is from 1.2-1.5 inches.

Figure 3:
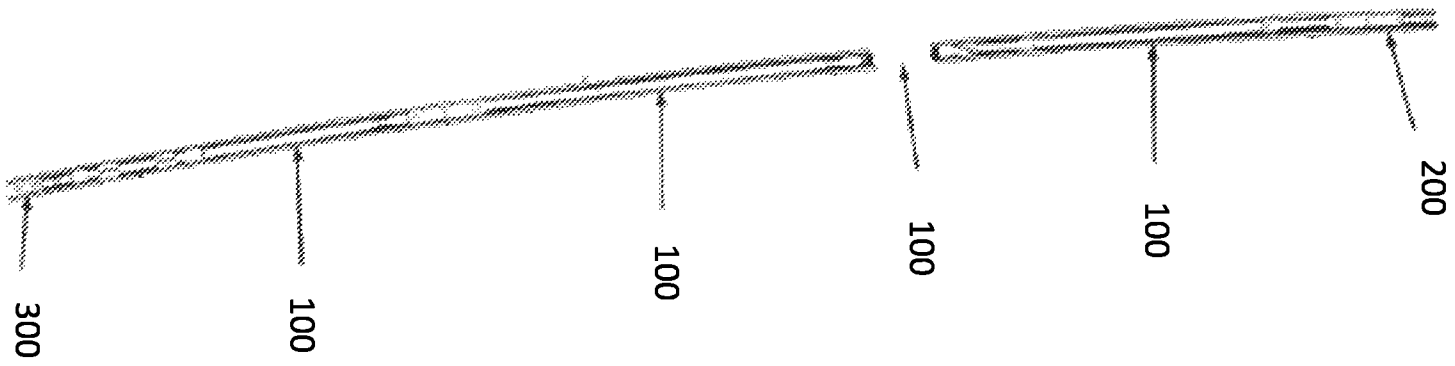
FIG. 3 depicts a production string comprising a sucker rod, multiple sinker bars, and a downhole pump.

FIG. 3 depicts a production string production string comprising a sucker rod 200, multiple sinker bars 100, and a downhole pump 300. The production string may include multiple sinker bars 100 or sucker rods 200. A downhole pump 300 is attached to the end of the production string. In an embodiment, the production string comprises at least one sinker bar 100, at least one sucker rod 200, and a downhole pump 300.

In an embodiment, the sinker bars are prepared from hot-rolled, cold-drawn carbon or alloy steel bar stock. Hot rolled, cold drawn bar stock improves the mechanical properties, surface integrity, and dimensional accuracy, tolerance and shape over bars not produced using the cold drawn method. Hot rolled, cold drawn sinker bars offer increased hardness, yield and tensile strength, which can provide increased fatigue strength and longer service life; provide better wear and corrosion resistance; and provide better resistance to handling damage.

Hot rolled, cold drawn sinker bars offer improved surface finishes, which can provide increased fatigue resistance and longer service life; and provide better wear and corrosion resistance.

Hot rolled, cold drawn sinker bars offer more precise and consistent cross-sectional geometries, straightness and bar-end conditions, which can provide greater cross-sectional uniformity.

Cold drawing prior to manufacturing increases the yield strength of the steel bar stock while keeping the diameter, straightness and out-of-round tolerance more consistent and without much increase in the tensile strength or hardness of the sinker bar. The overall result of the hot rolled, cold drawn material and advanced pin design is a sinker bar with increased fatigue endurance, strength, toughness and an improved surface finish on the outside diameter; which removes irregularities that may otherwise result in abrasion and wear to your production tubing.

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods and in the steps or in the sequence of steps of the methods described herein without departing from the concept, spirit and scope of the invention. More specifically, it will be apparent that certain components related may be substituted for the components described herein while the same or similar results would be achieved. All such similar substitutes and modifications apparent to those skilled in the art are deemed to be within the spirit, scope and concept of the invention as defined by the appended claims.

What is claimed is:

1. A sinker bar comprising an elongated tubular body having a shoulder portion present on at least one end of the tubular body;

a polished rod pin integrally adjacent to the shoulder portion of the elongated tubular body, wherein the polished rod pin comprises a polished rod pin end opposite of the shoulder portion;

wherein the shoulder portion is located at least 1.600 inches from the end of the polished rod pin;

a gauge ring present on the polished rod pin, wherein the gauge ring is located between the shoulder portion and the end of the polished rod pin and is greater than about 1.4 inches from the end of the polished rod pin; and wherein the polished rod pin can be mated with a coupling.

2. The sinker bar of claim 1 wherein the shoulder portion forms a 45 degree angle to the gauge ring.

3. The sinker bar of claim 1 further comprising a threaded connector portion of the pin.

4. The sinker bar of claim 3 wherein the threaded connector portion forms a 9 degree angle to the gauge ring.

5. The sinker bar of claim 3 wherein the threaded connector portion is in proximity to the gauge ring.

6. The sinker bar of claim 3 wherein the threaded connector portion is in proximity to the polished rod pin end.

7. The sinker bar of claim 3 wherein the threaded connector portion is between about 0.8 inches and 2.0 inches long.

8. The sinker bar of claim 1 wherein the sinker bar is comprised of at least one of the group consisting of carbon steel bar stock or alloy steel bar stock.

9. The sinker bar of claim 8 wherein the sinker bar stock is hot-rolled and cold-drawn.

10. The sinker bar of claim 1 wherein the gauge ring is located about 1.5 inches from the polished rod pin end.

11. A method of preparing a production string comprising attaching the sinker bar of claim 1 to the production string;

attaching a sucker rod to the production string; and attaching a pump to the production string.

12. The method of preparing the production string of claim 11 wherein the shoulder portion forms a 45 degree angle to the gauge ring.

13. The method of preparing the production string of claim 11 further comprising a threaded connector portion located on the polished rod pin.

14. The method of preparing the production string of claim 13 wherein the threaded connector portion forms a 9 degree angle to the gauge ring.

15. The method of preparing the production string of claim 13 wherein the threaded connector portion is between about 0.8 inches and 2.0 inches long.

16. The method of preparing the production string of claim 11 wherein the sinker bar is comprised of at least one of the group consisting of carbon steel bar stock or alloy steel bar stock.

17. The method of preparing the production string of claim 16 wherein the sinker bar stock is hot-rolled and cold-drawn.

18. The method of preparing the production string of claim 11 wherein the gauge ring is located about 1.5 inches from the polished rod pin end.

* * * * *